US007686306B2

(12) United States Patent
Au-Yeung

(10) Patent No.: US 7,686,306 B2
(45) Date of Patent: Mar. 30, 2010

(54) VARIATIONS IN AND RELATING TO ROULETTE

(76) Inventor: Chi Fat Au-Yeung, 105 Overdale Road, Quinton, Birmingham, West Midlands, B32 2QR (GB)

( * ) Notice: Subject to any disclaimer, the term of this patent is extended or adjusted under 35 U.S.C. 154(b) by 0 days.

(21) Appl. No.: 12/101,504

(22) Filed: Apr. 11, 2008

(65) Prior Publication Data

US 2008/0252004 A1 Oct. 16, 2008

(30) Foreign Application Priority Data

Apr. 13, 2007 (GB) ..... 0707123.6

(51) Int. Cl.
*A63F 5/00* (2006.01)

(52) U.S. Cl. ..... 273/274; 273/142 E; 273/142 R; 273/138.2; 273/146; 463/17; 463/22

(58) Field of Classification Search ..... 273/274, 273/142 E, 142 R, 142 D, 142 F, 142 G, 142 H, 273/142 HA, 142 J, 142 JA, 142 JB, 142 JC, 273/142 JD, 146, 138.2; 463/17, 22
See application file for complete search history.

(56) References Cited

U.S. PATENT DOCUMENTS 5,540,442 A * 7/1996 Orselli et al. ..... 463/17
6,176,489 B1 * 1/2001 Astaneha ..... 273/274

OTHER PUBLICATIONS

Grand Casino, Gulfport & Biloxi, Roulette Score Card, How the Bets are Placed, received in the PTO on Aug. 17, 2001.*

* cited by examiner

*Primary Examiner*—Benjamin H Layno
(74) *Attorney, Agent, or Firm*—Davis & Bujold, P.L.L.C.

(57) ABSTRACT

A method and apparatus of playing a variation of Roulette, permit a player to place a bet on the outcome of a spin of the Roulette wheel in combination with the outcome of one or more other random events.

13 Claims, 4 Drawing Sheets

VARIATIONS IN AND RELATING TO ROULETTE

This application claims priority from British Application Serial No. 0707123.6 filed Apr. 13, 2007.

INTRODUCTION AND DEFINITIONS

The present invention relates to a variation of Roulette.

Where the context so admits herein reference to the male shall include the female, use of the singular shall include the plural and vice versa and the following expressions shall bear the following meanings that is to say:

'the tariff' shall mean 'a list or schedule of pay-outs'

'standard bet' shall mean 'any bet available by using a chip or chips representing money when playing the traditional game of Roulette the standard (European) layout for which is illustrated in FIG. 1"

'plus-bet box' shall mean 'any of the boxes set out on any of the specially designed gaming cloths and so identified in the illustrations'

'plus-bet'shall mean 'a bet on the outcome of a standard roulette bet combined with the random event or events depicted by the Gaming Generator such bet being placed or registered in the appropriate plus-bet box'

'Treble-bet' shall mean 'a bet on the outcome of a standard roulette bet combined with the outcome of two random events depicted by the Gaming Generator and placed on the appropriate bet-box'

'accumulator bet' shall mean 'a bet on the outcome of a standard roulette bet combined with the outcome of three or more events depicted by the Gaming Generator and placed on the appropriate bet box'

'the Gaming Generator' shall mean 'an electronic device producing a random number, letter, colour or symbol or any combination of any of them' or alternatively 'one or more multi-sided devices displaying numbers, letters, colours or symbols, which device or devices may be real, virtual, mechanical, inert or digital'

'the additional equipment' shall mean "the Gaming Generator and the specially designed gaming cloths as illustrated' (FIG. 2, FIG. 3 or FIG. 4)

Equipment:

The equipment for the Game shall be a wheel with slots each of the same size and each identified with different numbers, letters or symbols, a ball capable when spun round the rim of the wheel to fit into and land in any one of the slots, specially designed gaming cloths (as illustrated in FIG. 2 and FIG. 2*a*) and a Gaming Generator.

The Game—Background

Roulette is a casino game from the French word for 'small wheel'.

In the game a dealer or croupier spins a wheel in one direction and a ball in the opposite direction around a tilted circular surface running around the rim of the wheel.

The ball eventually falls onto the wheel and into one of 37 (in European Roulette) or 38 (in American Roulette) coloured and numbered slots on the wheel.

Wheel Layout

The main slots are numbered from 1 to 36 alternating between red and black.

The slots are not in numerical order round the wheel. There is a neutral slot generally coloured green identified as zero (and in American Roulette there is also a second green slot marked double zero).

Betting

Players may place a variety of 'inside' bets (selecting the number of the slot or a range of slots in which the ball will land), and 'outside' bets being bets on whether the 'winning numbered slot' falls within a nominated one third of the wheel, or one of the identified even chances typically 1-18 or 19-36, red or black, or odd or even. The pay-out odds for each type of bet is based on its likelihood while allowing a small 'edge' to the roulette operator or casino. The bets are placed on the gaming cloth.

History

Roulette has been played in its current form since 1796 (in Paris).

In 1842 the zero (displayed as "0") was added to the roulette wheel in order to achieve a house advantage.

In the early 1800s roulette was introduced to the USA and a second zero, "00", was introduced. (In some forms of early American roulette the double-zero was replaced by an American Eagle.)

In the 1800s roulette spread all over both Europe and the USA becoming one of the most famous and most popular casino games.

Types of Bets

Inside Bets:

Straight: a single number. The chip is placed entirely on the middle of a number square.

Split: a bet on two adjoining numbers, either on the vertical or horizontal (as in 14-17 or 8-9). The chip is placed on the line between these numbers.

Street: a bet on three numbers on a single horizontal line. The chip is placed on the edge of a vertical line level with the three numbers intended to be covered by the bet e.g. 1-2-3 or 31-32-33.

Corner (or square): a bet on four numbers in a square layout (as in 11-12-14-15). The chip is placed at the horizontal and vertical intersection of the lines around the numbers.

Line or Six line: a bet on two adjoining streets with the chip placed at the corresponding intersection as if in between where two street bets would be placed.

Outside Bets

Evens: a bet on 18 numbers. This is placed in the a box representing the attribute (black/red, low/high, or even/odd) that the player intends to bet on.

Dozen or Group Bets: a bet on the first, second, or third group of twelve numbers i.e. 1 to 12, 13 to 24 or 25 to 36.

Column: a bet on all 12 numbers on any of the three vertical lines (such as 1-4-7-10 on down to 34). The chip is placed on the space below the final number in this string.

Standard Pay Table
In addition to each under-mentioned pay-out the bet is returned

| Bet name | Number of slots covered by the bet | Pay-out |
|---|---|---|
| 0 or zero | one | 35 to 1 |
| 00 or double zero | one | 35 to 1 (American Roulette only) |
| Straight up (single number other than zero or double zero | one | 35 to 1 |
| Split | two | 17 to 1 |
| Zero Row 0 + 00 | two | 17 to 1 (American Roulette only) |
| Street (e.g. Row 1-2-3) | three | 11 to 1 |

-continued

Standard Pay Table
In addition to each under-mentioned pay-out the bet is returned

| Bet name | Number of slots covered by the bet | Pay-out |
|---|---|---|
| five number (bet 0-00-1-2-3) | five | 6 to 1 (American Roulette only) |
| Column (e.g. 1-4-7 etc. to 34) | twelve | 2 to 1 |
| Dozen (e.g. 1 to 12 inclusive) | twelve | 2 to 1 |
| Odd or Even | eighteen | 1 to 1 |
| Red or Black | eighteen | 1 to 1 |
| Low (1 to 18) or High (19 to 36) | eighteen | 1 to 1 |

According to one aspect of the present invention in a variation of Roulette, a player may place a bet on the outcome of a spin of the Roulette wheel in combination with the outcome of one or more other random events.

Bets may be placed on the spin of the roulette wheel in accordance with conventional criteria, as described above. The other random event may comprise an electronic random generator device producing a random number, letter, colour or symbol or any combination of any of them, or alternatively one or more multi-sided device displaying numbers, letters, colours or symbols, which device or devices may be real, virtual, mechanical, inert or digital.

The odds paid out on a successful bet will be an appropriate multiple of the odds paid out on the conventional Roulette forming the first part of the bet, depending on the odds involved in predicting the outcome of the random event forming the second part of the bet.

According to a further embodiment of the invention, a player may place a bet on the outcome of a spin of the Roulette wheel in combination with the outcome of two or more, other random events.

BRIEF DESCRIPTION OF THE DRAWINGS

The invention is now described, by way of example only, with reference to the accompanying drawings, in which:—

The games in accordance with the present invention, as described below, may be played for fun or gaming purposes.

DETAILED DESCRIPTION OF THE INVENTION

Figure 1:
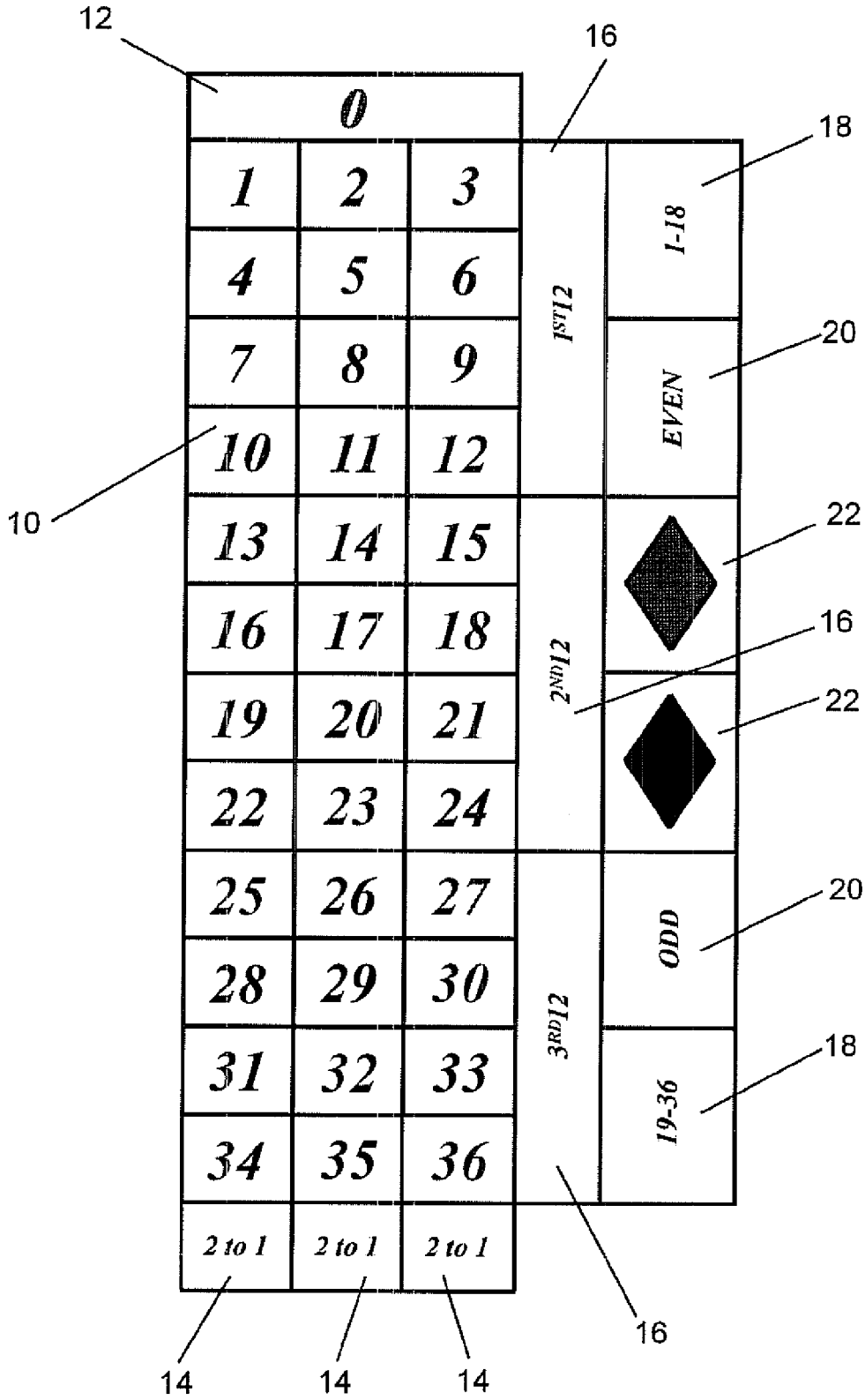
FIG. 1 is a layout for a gaming cloth for conventional Roulette.

In the conventional layout illustrated in FIG. 1, the numbers 1 to 36 of the roulette wheel are set out in a matrix 10 of three columns of twelve rows, with an additional box 12 of one row across all three columns, at the top for "0". Additional outside betting boxes 14 are provided at the bottom of each column, for placing bets on the twelve numbers from 1 to 36 in each of the columns. Further outside betting boxes are placed along the sides of the columns; boxes 16 for placing bets on numbers "1 to 12", "13 to 24" and "25 to 36" respectively; boxes 18 for or placing bets on numbers "1 to 18", and "19 to 36" respectively; boxes 20 for placing bets on "odd" and "even" respectively; and boxes 22 for placing bets on "red" or "black" respectively.

Figure 2:
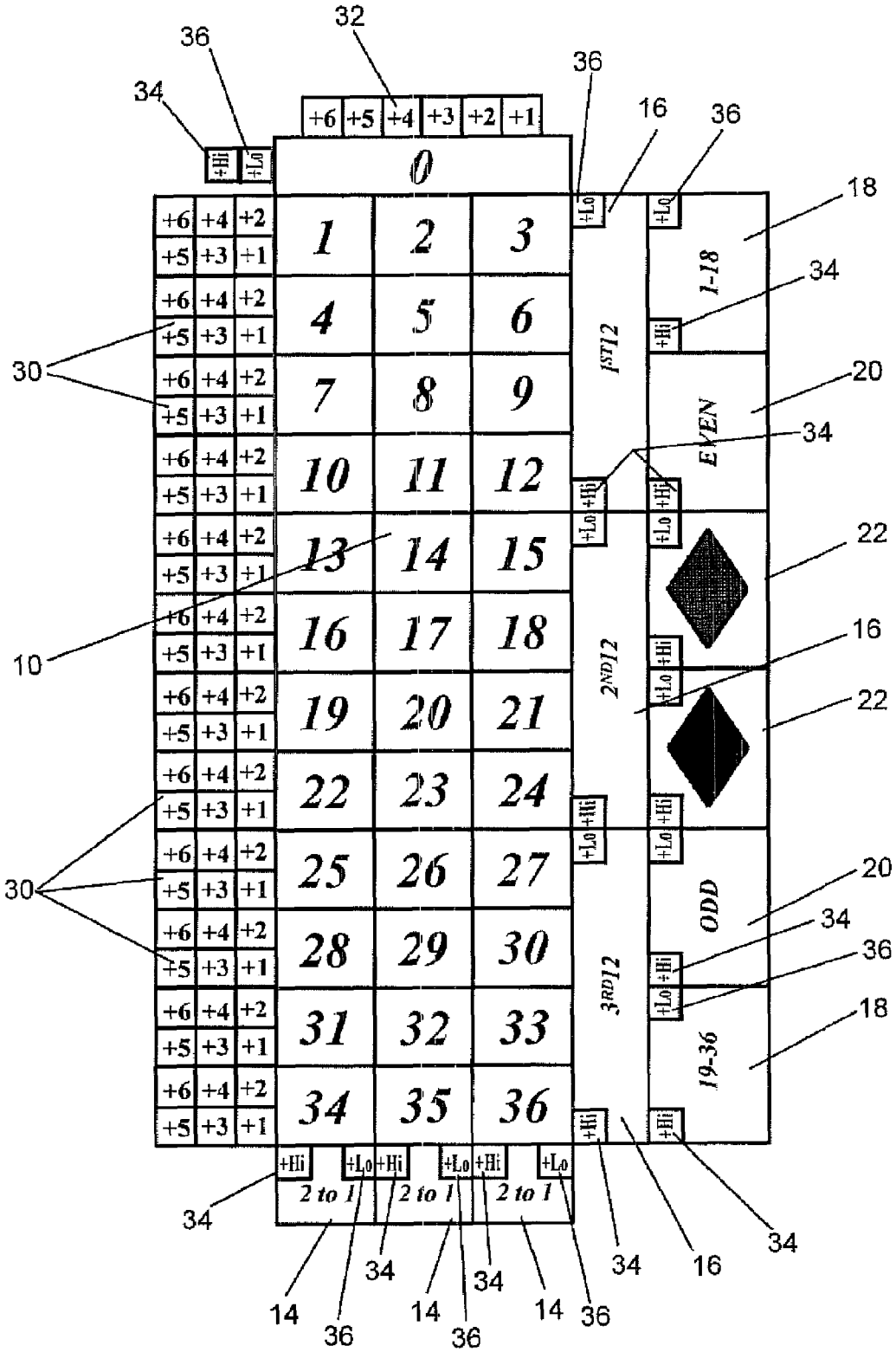
FIG. 2 is a layout for a gaming cloth for one embodiment of a game in accordance with the present invention.

According to one embodiment a game in accordance with the present invention may be played by any number of players on a specially designed gaming cloth as illustrated in FIG. 2, on which bets may be placed combining standard Roulette betting procedures coupled with additional betting boxes as illustrated.

A player may place a bet on the outcome of the spin of the Roulette Wheel only, in conventional manner as described above. In addition or alternatively the player may place a bet on the outcome of the spin of the Roulette Wheel in combination with the outcome of the throw of a six sided dicer the sides of the dice being numbered 1 to 6 or an electronic number generator which may randomly select any number from 1 to 6.

As illustrated in FIG. 2, the modified layout is based on the conventional Roulette layout of FIG. 1. Additional betting boxes 30 are provided, each box 30 corresponding to one row of the conventional Roulette layout. Each of the boxes 30 is subdivided into six boxes which are marked +1 to +6. A further additional betting box 32 corresponds to the 12 box of the conventional layout, the box 32 being subdivided into six boxes marked +1 to +6. Further additional boxes 34, 36 are associated with the box 12 and outside betting boxes 14 to 22 of the conventional layout, boxes 34 being marked "Hi" and boxes 35 being marked "Lo".

The dealer or croupier will spin the ball in the usual way and in addition will throw the dice or activate the electronic random number generator which will display a random number of from 1 to 6.

In order to be paid the players must successfully forecast the outcome of both events that is the number on the wheel against which the spun ball shall have come to rest and the random number displayed by the dice or random number generator.

In addition to the conventional betting options, a player may:—

- Place a bet in one subdivisions of one of the boxes 30, to bet on the three numbers in the row corresponding to the particular box 30, for example 1, 2 and 3, the subdivision corresponding to one of the numbers +1 to +6, for example +4. The player will win the bet if the number coming up on the Roulette wheel is 1, 2 or 3 and the number thrown on the dice or generated by the random number generator is 4. The player is played out at the odds given in the pay table below.
- Place a bet in one subdivisions of one of the box 32, to bet on "0", the subdivision corresponding to one of the numbers +1 to +6, for example +3. The player will win the bet if the number coming up on the Roulette wheel is "0" and the number thrown on the dice or generated by the random number generator is 3. The player is paid out at the odds given in the pay table below.
- Place a bet in one or more of the boxes 34 or 36 associated with box 12 or boxes 14 to 22 of the conventional layout. The player will win the bet placed in one of the boxes 34 if "0" or the conventional outside bet corresponding to the box 14 to 22 comes up and the number thrown on the dice or generated by the random number generator is 4 to 6. The player will win the bet placed in one of the boxes 36 if "0" or the conventional outside bet corresponding to the box 14 to 22 comes up and the number thrown on the dice or generated by the random number generator is 1 to 3. The player is paid out at the odds given in the pay table below.

| PAY-OUT TABLE<br>In addition to each under-mentioned pay-out the bet is returned | |
|---|---|
| Zero and (+1 to +6) (Box 32) pays: | 210 to 1 |
| Zero and (+Hi or +Lo) (Box 34 or 36) pays: | 70 to 1 |
| Row and (+1 to +6) (Box 30) pays: | 70 to 1 |
| Column and (+Hi or +Lo) (Box 34 or 36 in Box 14) pays: | 5 to 1 |
| 1-12, 13-24 or 25-36 and (+Hi or +Lo) (Box 34 or 36 in Box 16) pays: | 5 to 1 |
| 1-18 or 19-36 and (+Hi or +Lo) (Box 34 or 36 in box 18) pays: | 5 to 1 |
| Odd or Even and (+Hi or +Lo) (Box 34 or 36 in Box 20) pays: | 3 to 1 |
| Black or Red and (+Hi or +Lo) (Box 34 or 36 in Box 22) pays: | 3 to 1 |

Figure 3:
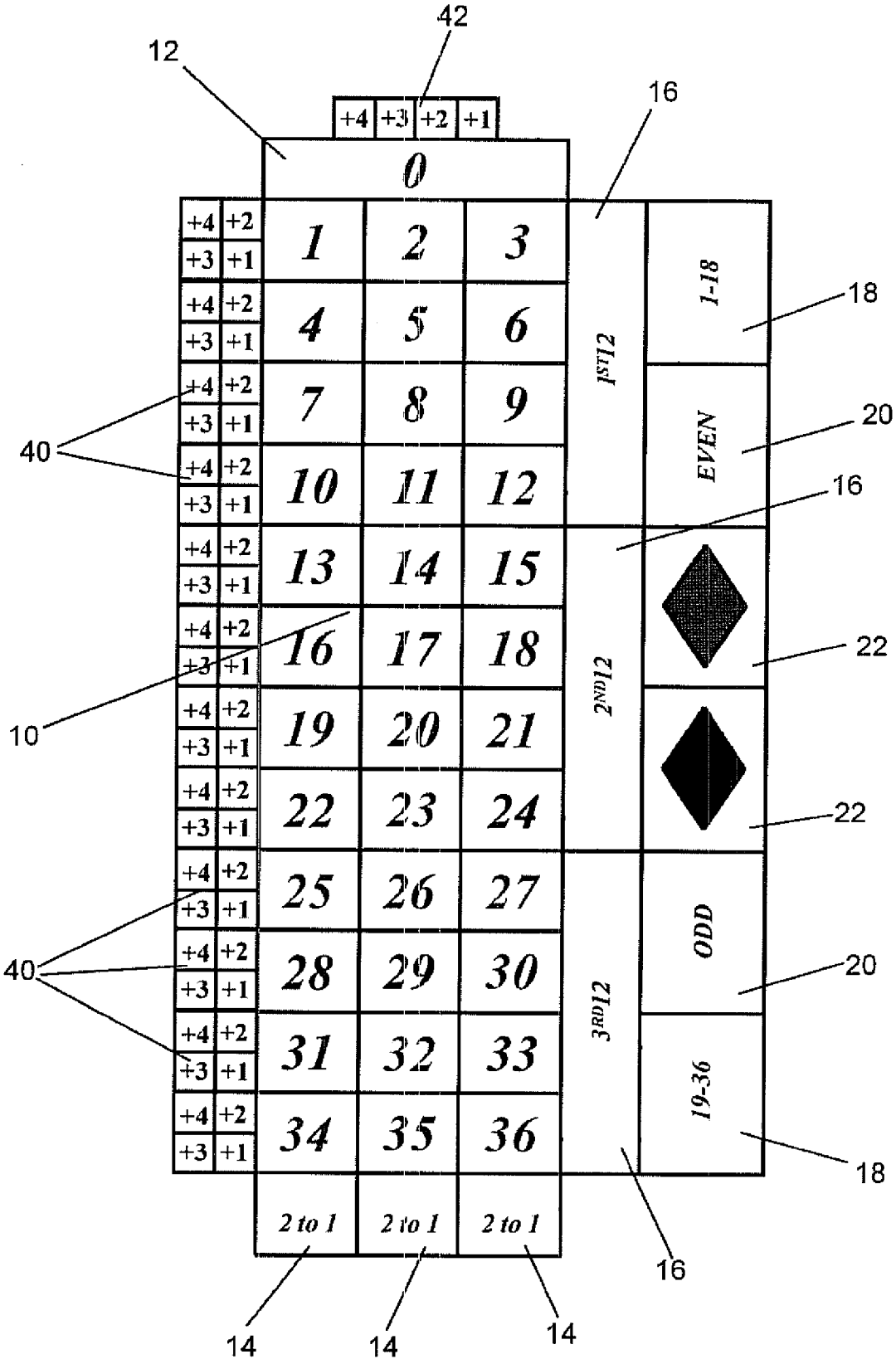
FIG. 3 is a layout for a gaming cloth for an alternative embodiment of a game in accordance with the present invention.

In a simplified embodiment of the game described above, as illustrated in FIG. 3, the (Hi-Lo) options are dispensed with. Furthermore boxes 40, 42 corresponding to boxes 30 and 32 of the embodiment illustrated in FIG. 2, are divided into four, the four boxes being numbered +1 to +4. The random number generator in this case is a twelve sided dice with three faces numbered +1 to +4 respectively. Alternatively an electronic random number generator capable of generating numbers +1 to +4 may be used.

With this embodiment of the game the pay out table may be as follows:—

| PAY-OUT TABLE<br>In addition to each under-mentioned pay-out the bet is returned | |
|---|---|
| Zero and (+1 to +4) (Box 42) pays: | 140 to 1 |
| Row and (+1 to +4) (Box 40) pays: | 45 to 1 |

Figure 4:
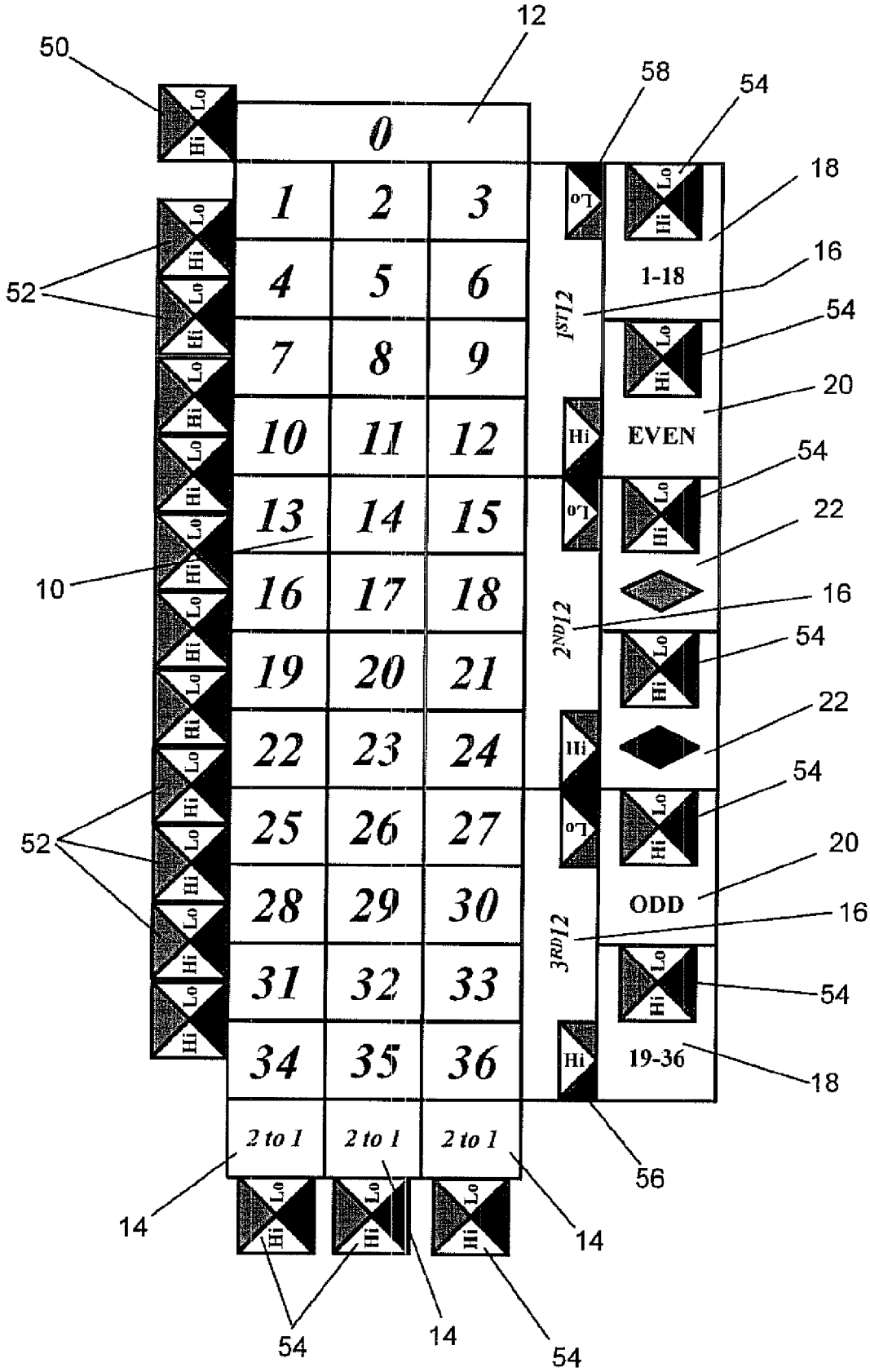
FIG. 4 is a layout for a gaming cloth for a further embodiment of a game in accordance with the present invention.

In the further embodiment illustrated on FIG. 4, a player has an opportunity of placing a bet on the outcome of a spin of the roulette wheel together with two additional random events. This embodiment of the game in accordance with the present invention may be played by any number of players on a specially designed gaming cloth on which bets may be placed combining standard Roulette betting procedures coupled with additional betting boxes as illustrated in FIG. 4.

In addition to the conventional roulette wheel, the equipment for playing the game may include a first random generator, for example an dice with an even number of sides, the sides of the dice being marked with a series of numbers, for example the dice may have six sides marker 1 to 6. Alternatively, equal numbers of the faces may be marked "Hi" and "Lo". A second random generator, for example a dice with an even number of sides, equal numbers of the sides being of different colour, for example "Red" or "Blue". In place of the first and second random generators, an electronic generator may be used to randomly select either "Hi" or "Lo" and either "Red" or "Blue". According to a further alternative a single, a single twelve sided dice may have six pairs of sides marked 1 to 6, one of each pair being marked "Red" while the other it each pair is marked "Blue", so that a throw of the dice will give a random selection of "Hi" (4 to 6) or "Lo" (1 to 3) and "Red" or "Blue". It should be remembered that "Red" in this context refers to "Red" on the random generator and not "Red" as opposed to "Black", in the conventional Roulette game.

As illustrated in FIG. 4, an additional betting box 50 corresponds to the zero box 12 of the conventional Roulette layout; additional betting boxes 52 are aligned intermediate of the rows of the matrix 10 of the conventional Roulette layout; additional betting boxes 54 are provided in boxes 14, 18, 20 and 22 of the conventional roulette layout; and additional betting boxes 56, 58 are provided in each of the boxes 16 of the conventional Roulette layout. The boxes 50, 52 and 54 are quartered diagonally, opposite quarters being marked "Hi" and "Lo" and the other opposite quarters being coloured "Red" and "Blue". In order to fit in with the conventional layout, the boxes 56 and 58 correspond to half's of the boxes 50 to 54, box 56 being marked "Hi" and "Red" and "Blue" and box 58 being marked "Lo" and "Red" and "Blue".

The dealer or croupier will spin the ball in the usual way and in addition will throw the dice or activate the electronic random number generator which will; display a random number of from 1 to 6 (1 to 3 being "Lo" and 4 to 6 being "Hi") and a random colour "Red" or "Blue".

In order to be paid the players must successfully forecast the outcome of all three events that is the number on the wheel against which the spun ball shall have come to rest, whether the random number displayed by the dice or random number generator is "Hi" or "Lo" and whether the random colour is "Red" or "Blue".

The player indicates his bet by placing a bet in one or more of the boxes 50 to 58, on the diagonal between the selected choice of "Hi" or "Lo" and the selected choice of "Red" or "Blue"

In addition to the conventional betting options, a player may place a bet on "Hi" or "Lo" and "Red" or "Blue" in combination with the spin of the Roulette wheel coming up:—

Zero (Box 50);
One of a series of six, numbers e.g. (1 to 6) (Box 52);
A column of 12 numbers (Box 54);
1-18, 9-36 (Box 54),
Even, Odd (Box 54);
Red, Black (Box 54); and/or
1-12, 13-24, 25-36 (boxes 56, 58)

the successful bets being paid out, for example, at the odds set out in the table below.

| Pay-Out Table<br>in addition to each under-mentioned pay-out the bet is returned | |
|---|---|
| Zero and ("Hi" or "Lo") and ("Red" or "Blue") pays: | 140 to 1 |
| One of six numbers, and ("Hi" or "Lo") and ("Red" or "Blue") pays: | 22 to 1 |
| Column and ("Hi" or "Lo") and ("Red" or "Blue") pays: | 11 to 1 |
| 1-12, 13-24, 25-36 and ("Hi" or "Lo") and ("Red" or "Blue") pays: | 11 to 1 |
| 1-18, 9-36 and ("Hi" or "Lo") and ("Red" or "Blue") pays: | 7 to 1 |
| Even, Odd and ("Hi" or "Lo") and ("Red" or "Blue") pays: | 7 to 1 |
| Red, Black and ("Hi" or "Lo") and ("Red" or "Blue") pays: | 7 to 1 |

In an alternative embodiment of the game illustrated on FIG. 4, a player may have the option of betting on a combination of the spin of the roulette wheel with only one random event, either "Hi" or "Lo" or "Red" or "Black", by placing the bet in the quarter appropriately marked rather that on the diagonal. For this option, the odds paid will be appropriately adjusted.

In alternative embodiments the games described herein may be played with roulette wheels having more or fewer slots, with slots identified by symbols or letters and/or plus-bet boxes with more or fewer betting opportunities.

In alternative embodiments the games described herein may be played with three or more different random events generated in addition to the standard Roulette number, group or range of numbers or any combination of two or more such random events all or any such additional random events shall be generated by the Gaming Generator or Generators.

In alternative embodiments the games described herein or any variation thereof may also be adapted for Internet entertainment, video slot machines, computer programs, interactive television or any electronic medium in such case the term 'gaming cloth' as herein described is intended to cover a virtual representation of a gaming cloth and the term 'Gaming Generator' is intended to cover a virtual representation thereof.

Furthermore use of the term 'cloth' is not intended to restrict the claims to use of a particular material but will cover any medium which defines a playing area for the games, whether real, virtual, artificially illuminated or otherwise.

Furthermore one or more Gaming Generators may be used in the course of playing the Game or any of the Games described or referred to herein.

Additionally or alternatively the game or any variation thereof may be played or adapted for use in or as a lottery, on a scratch-card or by random selection of labelled balls or other equipment.

With the American version of the conventional game in which boxes, corresponding to box 12 of the European version of the game, are provided for "0" and "00" the options for additional bets may include individual additional bets on "0" and "00", an additional bet on "0-00" and/or an additional bet on "0, 00, 1, 2, 3".

The invention claimed is:

1. A method of playing a variation of Roulette, the method comprising the steps of:

a. providing a roulette wheel;

b. providing a roulette layout having betting areas whereby one or more players may place a bet on the outcome of a spin of the roulette wheel;

c. providing a random generator device to produce one or more random events; and d. providing a plurality of separate multi-choice random event betting areas corresponding to the random events produced by the random generator device, each separate multi-choice random event betting area being associated with one or more different betting areas of the roulette layout, whereby players may place a bet forecasting separately the outcomes of a spin of the roulette wheel and a random event produced by the random generator device;

e. allowing the at least one player to place a bet on at least one of;

the outcome of a spin of the roulette wheel, and the outcome of a spin of the roulette wheel and the random event of the random generator device;

f. spinning the roulette wheel and, at the same time, generating a random event via the random generating device;

g. determining whether the at least one player placed a winning bet; and h. paying each winning bet.

2. The method according to claim 1 in which the random generator device produces a random number, letter, color, or symbol or any combination thereof.

3. The method according to claim 1 in which the random generator device is one or more multi-faceted devices displaying numbers, letters, colors or symbols, which device or devices may be real, virtual, mechanical, inert or digital.

4. The method according to claim 1 in which there is a one in two chance of predicting the outcome of the or each random event.

5. The method according to claim 4 in which the or each player in addition to predicting the outcome of the spin of the roulette wheel must also predict whether a number produced by the random generator device, from a series of number, is in a lower half of the series, "Lo" or a higher half of the series "Hi".

6. The method according to claim 4 in which the or each player in addition to predicting the outcome of the spin of the roulette wheel must also predict a color produced by the random generator device from a series of two colors.

7. The method according to claim 1 in which there is a one in more that two chance of predicting the outcome of the or each random event.

8. The method according to claim 7 in which the or each player in addition to predicting the outcome of the spin of the roulette wheel must also predict the number produced by the random generator, from a series of three or more numbers.

9. The method according to claim 7 in which the or each player in addition to predicting the outcome of the spin of the roulette wheel must also predict the number produced by the random generator device, from an even series of numbers or whether the number produced is in the lower half of the series "Lo" or the higher half of the series "Hi".

10. The method according to claim 1 in which the or each player in addition to predicting the outcome of the spin of the roulette wheel must also predict; whether a number produced by the random generator device, from an even series of numbers, is in the lower half of the series "LO" or the higher half of the series "Hi"; and also the color generated by a second random generator device from a series of two colors.

11. The method according to claim 1 in which the bet on the outcome of a spin of the Roulette wheel may be a prediction that the number spun is one of the group including; zero; double zero; one of the group including zero and double zero; one or a row of three numbers; one of a the group including zero, double zero. 1, 2 and 3; one of a group six numbers in two adjacent columns; one of a group of 12 numbers in a column; on of twelve numbers from 1 to 12, 13 to 24 or 25 to 36, one of eighteen numbers from Ito 18 or 19 to 36; one of the even numbers; one of the odd numbers; once of the red numbers; and one of the black numbers.

12. The method according to claim 1 in which one or more players may place multiple bets on the outcome a spin of a roulette wheel and one or more other random events produced by the random generator device.

13. A method of playing a variation of Roulette, the method comprising the steps of:

a. providing a roulette wheel;

b. providing a roulette layout having betting areas whereby at least one player may place a bet on the outcome of a spin of the roulette wheel;

c. providing a random generator device for producing at least one random event;

d. providing a plurality of separate multi-choice random event betting areas corresponding to each random event of the random generator device, with each separate multi-choice random event betting area being associated with at least one different betting area of the roulette layout so that any bet on the multi-choice random event betting area places a bet on a selected combination of the outcome of a spin of the roulette wheel and a random event produced by the random generator device;

e. allowing the at least one player to place a bet on at least one of:

the outcome of a spin of the roulette wheel, and the outcome of a spin of the roulette wheel and the random event of the random generator device;

f. spinning the roulette wheel and, at the same time, generating a random event via the random generator device;

g. determining whether the at least one player placed a winning bet; and h. paying each winning bet.

* * * * *